United States Patent [19]

Weiss et al.

[11] Patent Number: 4,970,993

[45] Date of Patent: Nov. 20, 1990

[54] PORTABLE HANDHELD MOTOR TOOL HAVING A ONE-PIECE FAN HOUSING

[75] Inventors: Hermann Weiss, Steinheim; Siegfried Frank, Remshalden/Buoch; Wolfgang Kirtz, Berglen; Luise Stephani, Korb, all of Fed. Rep. of Germany

[73] Assignee: Andreas Stihl, Waiblingen, Fed. Rep. of Germany

[21] Appl. No.: 493,796

[22] Filed: Mar. 15, 1990

[30] Foreign Application Priority Data

Mar. 18, 1989 [DE] Fed. Rep. of Germany ..... 3908946

[51] Int. Cl.[5] ..... F01P 1/02

[52] U.S. Cl. ..... 123/41.7; 123/41.65

[58] Field of Search ..... 123/41.56, 41.65, 41.7, 123/198 E, 41.66

[56] References Cited

U.S. PATENT DOCUMENTS

| | | | |
|---|---|---|---|
| 3,120,840 | 2/1964 | Hatz | 123/41.66 |
| 4,261,302 | 4/1981 | Sheldon | 123/41.56 |
| 4,573,544 | 3/1986 | Hoch et al. | 123/41.66 |

*Primary Examiner*—Noah P. Kamen

*Attorney, Agent, or Firm*—Walter Ottesen

[57] ABSTRACT

The invention relates air-cooled combustion engine powered handheld tool. A fan screen has radial struts and tranverse walls which together define windows. The effective intake suction area of the fan is less than the area of the screen. Wood chips and the like are kept out by the size of the windows and the reduced air flow velocity through the screen.

8 Claims, 6 Drawing Sheets

33
34
24
13
13'
24'
34
33
28
17
31'
23
32

PORTABLE HANDHELD MOTOR TOOL HAVING A ONE-PIECE FAN HOUSING

FIELD OF THE INVENTION

The invention relates to a portable handheld tool such as a motor chain saw, cutoff machine or the like having a one-piece fan housing. The portable handheld tool has a work tool driven by a motor such as an internal combustion engine and has a fan for moving a cooling flow of air for the engine. The fan draws in ambient air via a fan screen with the intake surface of the fan screen being greater than the effective intake suction area of the fan. A deflector section is arranged between the fan screen and the fan and is tapered so as to become smaller from the fan screen to the intake opening.

BACKGROUND OF THE INVENTION

The fan arranged in the tool is covered by a fan housing connected to the housing of the tool by means of threaded fasteners. The fan housing has a forward fan screen and a rearward intake opening. The fan screen is configured so as to be as large as possible for obtaining a reduced in-flow velocity in the plane of the fan screen. For this reason, a deflector section is arranged between the fan screen and the fan for bridging the diameter difference between the inlet surface of the fan screen and the effective intake cross section of the fan.

It is known to produce the outer fan housing with the fan screen as an injection molded part preferably made of plastic and to then attach the deflecting section in the fan housing as an assembly part. This configuration assures that for the injection molding process, the windows of the fan screen formed by struts and transverse struts can be formed to have the same size. A one-piece configuration of the fan housing, fan screen and the deflector section cannot, however, be obtained with a constant window size in the fan screen.

SUMMARY OF THE INVENTION

It is an object of the invention to provide a portable handheld tool wherein the fan housing is so configured that it can be formed as one piece with the deflector section while having window sizes which are substantially uniform. It is another object of the invention to provide such a fan housing which can be produced by the injection molding process.

The portable handheld motor tool of the invention can be a motor chain saw, cutoff machine or the like. The motor tool of the invention has a work tool and includes: a motor housing; a motor for driving the work tool; the motor being mounted in the housing and having a drive shaft; a fan defining an effective intake suction area and being mounted on the drive shaft for drawing a flow of cooling air into the housing and through the intake opening for cooling the motor; a fan screen structure mounted on the housing and defining a fan screen for passing the cooling air into the housing from the ambient; the fan screen defining an intake area through which the cooling air passes and the intake area being greater than the intake suction area of the fan; the structure including a deflector section formed as one piece with the structure, the deflector section being disposed between the fan screen and the intake suction area so as to taper from the intake area down to the intake suction area; the fan screen having an overlap portion overlapping the deflector section to define a space therewith disposed therebetween; the structure defining a longitudinal axis and including a plurality of radial struts extending approximately radially of the axis so as to extend across the space as solid uninterrupted walls between the overlap portion and the deflector section; the structure further including a plurality of transverse struts in the slots so as to extend transversely between the walls; the transverse struts having respective ends facing toward the deflector section; and, each of the ends being chamfered toward the intake suction area.

The radial and transverse struts conjointly define a plurality of channels directed toward the intake opening of the fan.

The special form of the channels configured in the overlapping region make possible a manufacture of the fan housing or fan screen structure as a one-piece injection molded part while maintaining uniform window size. This fan screen structure produced as a single piece has a large inlet surface in the plane of the fan screen so that low in-flow velocities are obtained. Because the windows are substantially all of the same size, the windows will reliably hold back foreign particles such as wood chips which are larger than the windows. An adherence of the foreign particles on the windows is likewise prevented since the flow velocity in the plane of the fan screen can be held low because of the large expanse of the fan screen.

The configuration of the fan housing or fan screen structure according to the invention therefore affords advantages both in production and when in use.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
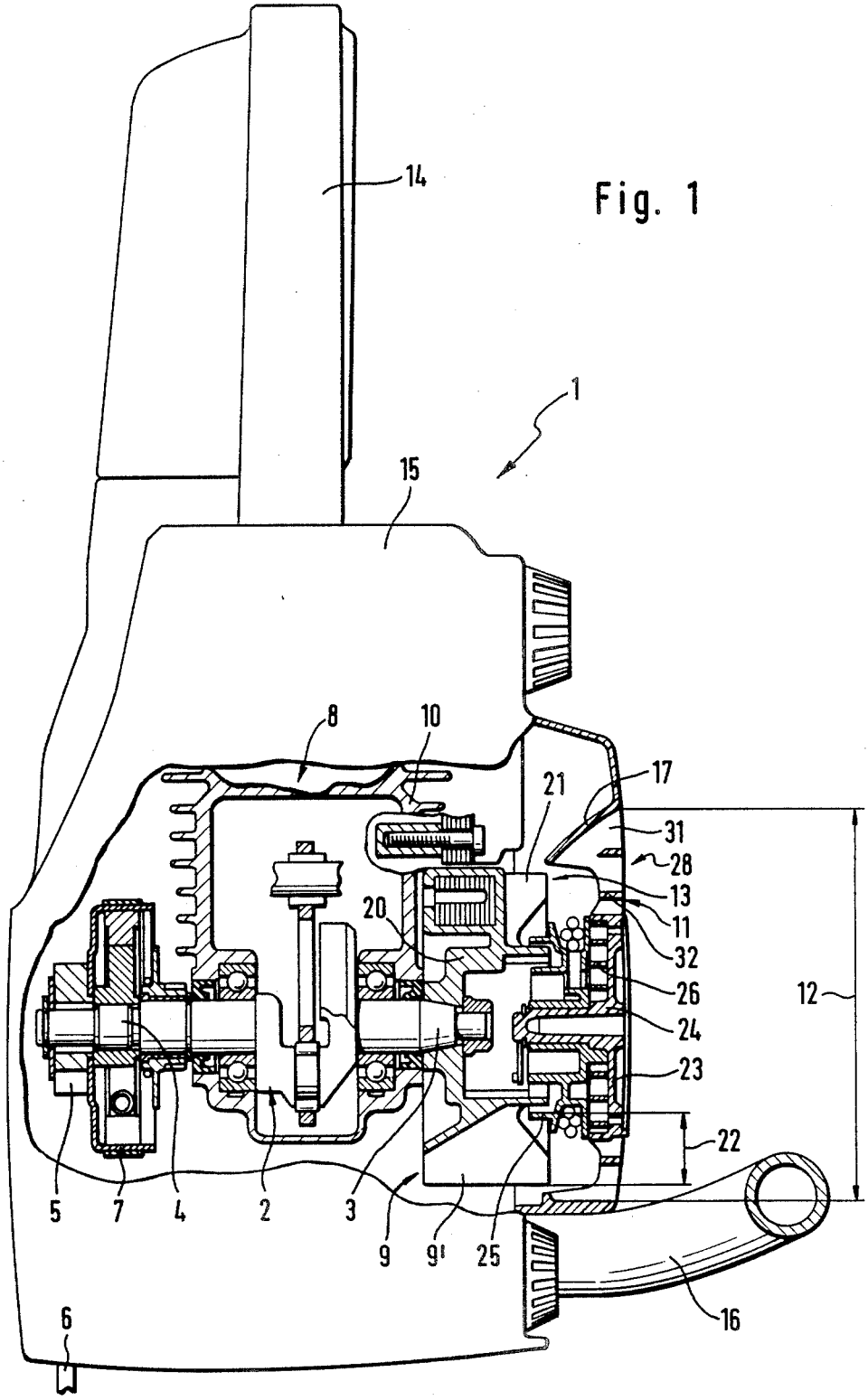
FIG. 1 is a plan view of a portable handheld motor chain saw wherein a portion of the housing thereof is broken out to show details of the fan housing and of the engine with the fan mounted on the end of the crankshaft thereof.

The plan view of FIG. 1 of the motor chain saw 1 shows that the crankshaft 2 of the drive motor 8 has a sprocket wheel 5 at one end 4 thereof for driving a saw chain (not shown) moving about the guide bar 6. A brake drum 7 is also provided at end 4 and is attached to the sprocket wheel 5 so as to rotate therewith and is utilized for braking the saw chain. The brake drum 7 is dispersed between the drive sprocket 5 and the engine 8.

The motor chain saw 1 is held and guided by means of a handle arrangement including a rearward handle 14 and a bale handle 16 (shown partially) which surrounds the housing 15 of the chain saw.

At the other end 3, the crankshaft 2 carries a fan wheel 9' of a fan 9 which supplies cooling air to the cylinder 10 of the engine 8. The fan wheel 9' is covered by a fan screen 11 having an inlet surface 12 larger than the effective intake suction area 13 of the fan 9. The effective area being the cross-sectional area swept out by the fan vanes.

Figure 2:
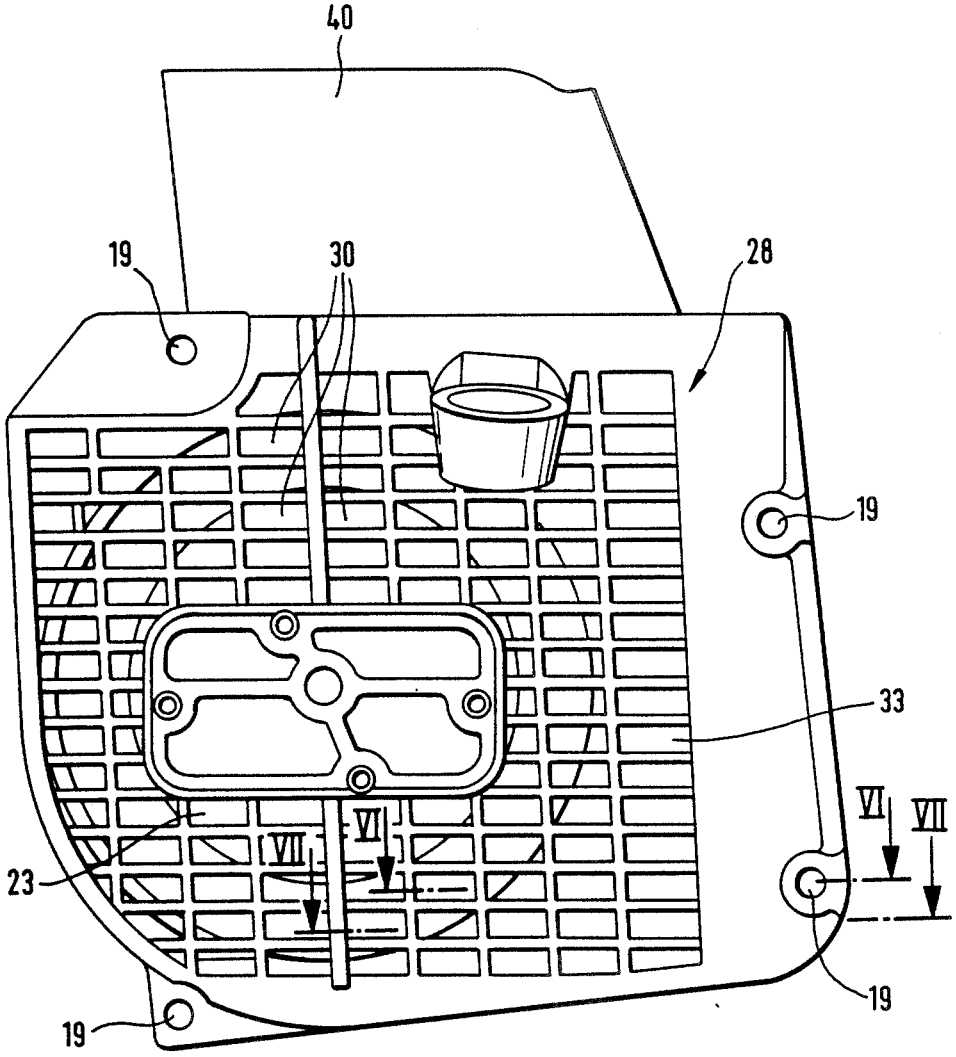
FIG. 2 is a view of the fan housing fixed on the housing of the motor chain saw of FIG. 1.

A funnel-shaped deflector section 17 is arranged between the fan screen 11 and the fan wheel 9'. At the smaller end thereof, the deflector section has an opening at the intake suction area 13 of the fan and, at the larger end, the deflector section has an opening corresponding to the inlet surface 12 of the fan screen 11. The fan screen 11 and the deflector section 17 are displaced with respect to each other when referred to their perpendicular center axes 13' and 11', respectively, so that a larger overlapping region 28 is provided at the side of the fan screen 11 between the fan screen and the deflector section 17 as can be seen in FIG. 2.

Figure 3:
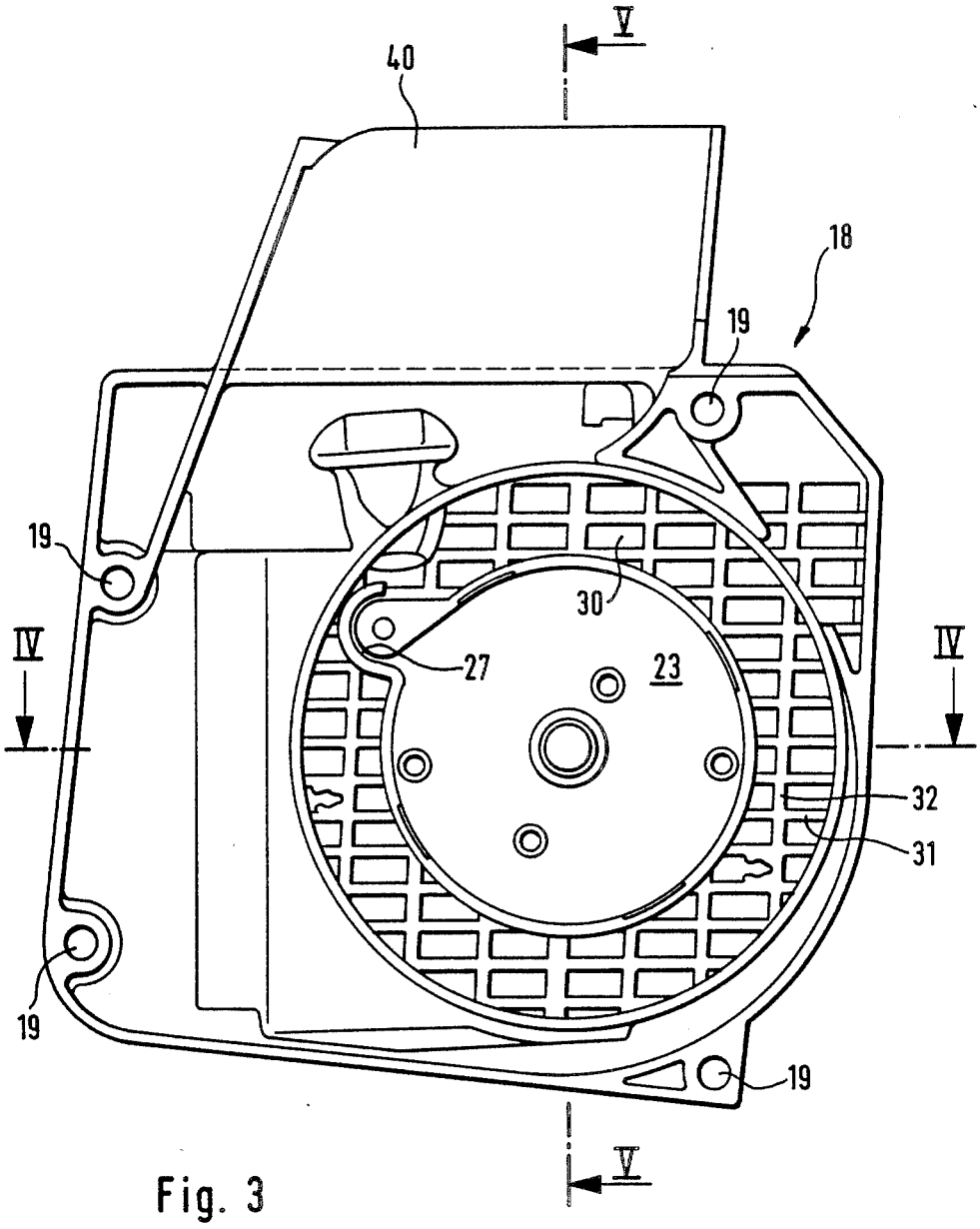
FIG. 3 is a rear view of the fan housing of FIG. 2.

The deflector section 17 and the fan screen 11 are configured so as to be one piece and conjointly define a housing part identified as fan housing 18. The fan housing 18 is attached to the housing 15 of the motor chain saw by means of threaded fasteners (not shown) extending through the attachment openings 19. In this position, the fan housing 18 covers the fan wheel 9' (FIGS. 1 to 3).

The fan wheel 9' comprises a cylindrical base body 20 (FIG. 1) having radially extending vanes 21 formed on the outer periphery thereof. The effective intake section of the fan 9 extends over an annular zone 22 having an outer diameter determining the diameter of the intake opening 13 of the fan 9.

In the fan housing 18, a cover plate 23 lies opposite the cylindrical base body 20 and is formed to have a diameter somewhat larger than the outer diameter of the base body 20.

A bearing shaft 24 extends from the center of the cover plate 23 so as to be coaxial with the fan wheel 9' and the crankshaft 2. The shaft 24 extends into the base body 20 and the end thereof lies spaced from the end 3 of the crankshaft. The drum 25 of a pull-rope starter is journalled on the shaft 24 and the return spring 26 of the starter is mounted between the drum 25 and the cover plate 23. The one end of the return spring 26 is held in a seat 27 (FIG. 3) formed in the cover plate to correspond with the end of the spring 26. The other end of the spring is attached to the drum 25. A latching device is effective between the drum 25 and the fan wheel 9' and makes possible a rotationally fixed coupling of the rope drum 25 with the fan wheel 9' when rotating the rope drum by means of the hand starter.

The cover plate 23 is integrated into the fan screen 11 and is configured as one piece with the shaft 24. The end 24' of the shaft 24 is provided with a slot (FIG. 5) for holding a clip spring for starter detents and holds the rope drum on the shaft 24.

As shown in FIGS. 2 and 3, the fan screen 11 of the fan housing has windows 30 of a uniform size defined by the struts 31 and 32 while providing a large effective air inlet surface 12. This is achieved especially in the overlapping region 28 by a special configuration of the struts 31 and the transverse struts 32 which define channels 33 which extend inclined to the center axis 13' of the inlet opening 13 (FIG. 4 to FIG. 7).

Figure 4:
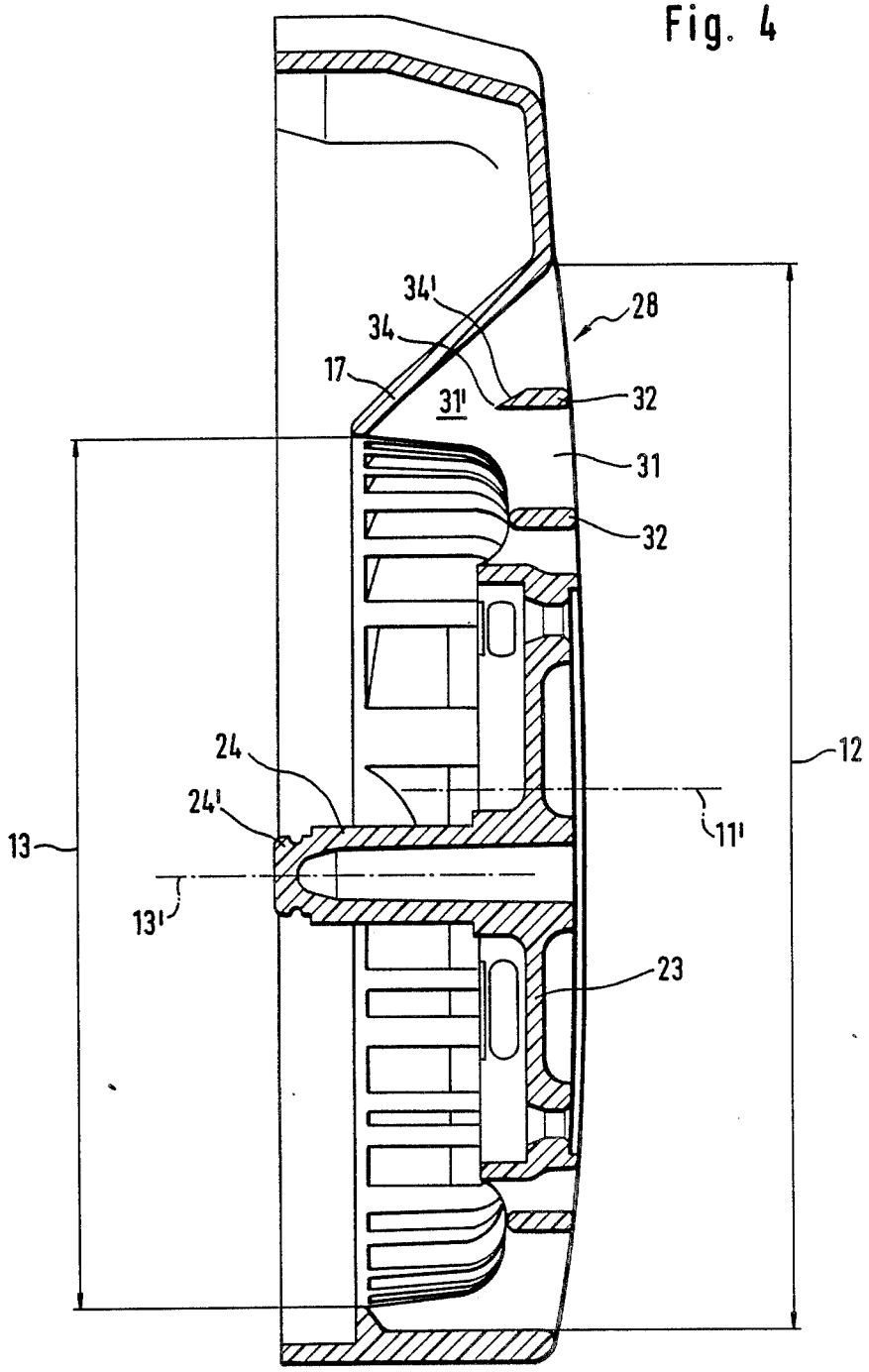
FIG. 4 is a section view taken along line IV—IV of FIG. 3.
Figure 5:
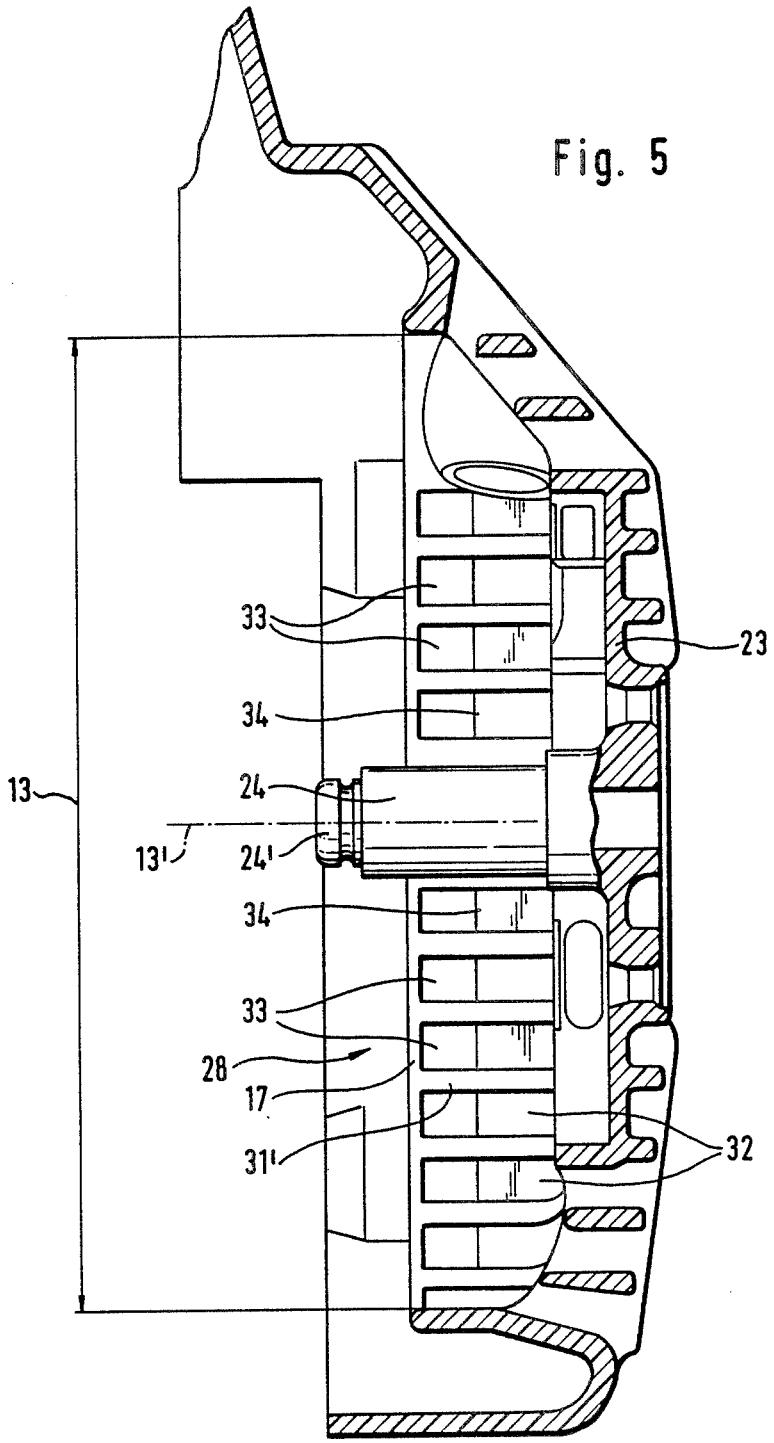
FIG. 5 is a section view taken along line V—V of FIG. 3.

As shown in FIGS. 4 and 5, the struts 31 are configured as walls 31' extending through to the deflector section 17 in the overlapping region 28 with the struts 31 extending approximately radially. The transverse struts 32 extend transversely to the struts 31 configured as walls 31'. The struts 32 have ends 34 which face toward the deflector section 17 and which are chambered in the direction toward the intake suction area 13 as shown, for example, in FIG. 4. The chamber 34' is provided at the end of the transverse strut 32 facing away from the center axis 13' of the intake suction area 13 so that the struts 32 are tapered on one side in the direction toward the deflector section 17.

Figure 6:
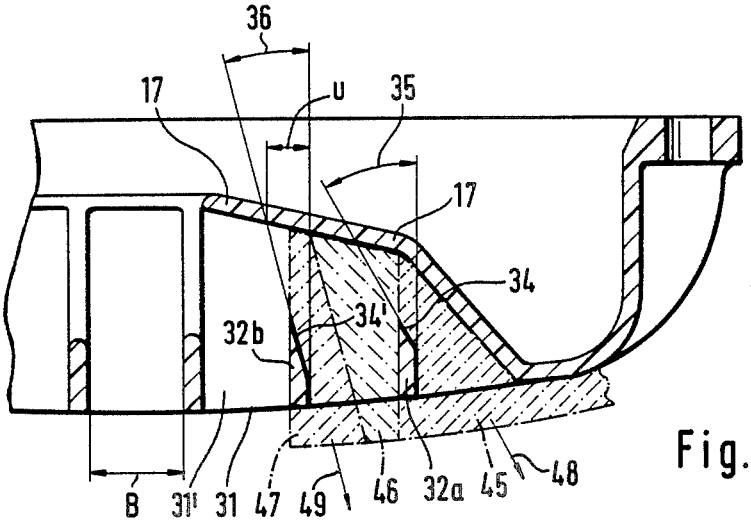
FIG. 6 is a section view taken along line VI—VI of FIG. 2.
Figure 7:
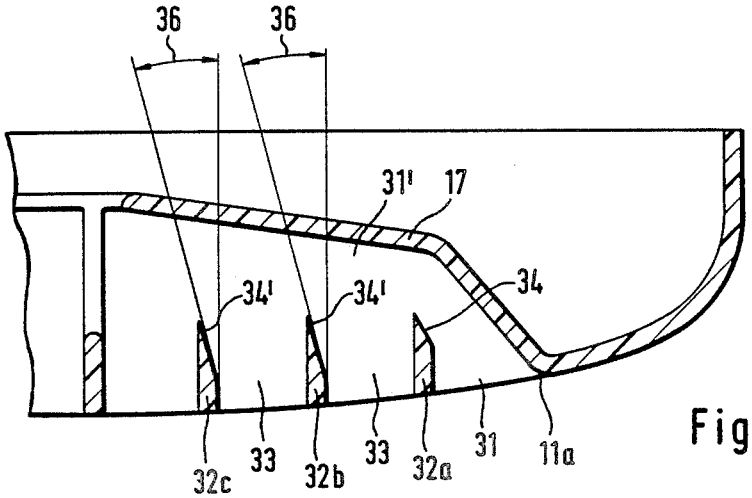
FIG. 7 is a section view taken along line VII—VII of FIG. 2.

Details as to the configuration of the transverse struts 32 are shown in the enlarged views of FIGS. 6 and 7. The transverse strut 32*a* is directly adjacent the outer edge 11*a* of the fan screen 11 and is chamfered at its end 34 at an angle 35 of preferably 30°. The inner transverse struts 32*b* are adjacent the transverse struts 32*a* and lie further away from the edge 11*a*. In contrast to the angle 35, the transverse struts 32*b* are chamfered at an angle 36 of preferably approximately 15° to the intake suction area 13. In this way, the struts 31 and transverse struts 32 conjointly define channels 33 directed toward the intake opening. The channels 33 have a greater inclination in the edge regions 11*a* of the fan screen 11 than in the inner zone of the screen. Because of this configuration, the air flowing into the channels 33 at an angle to the center axis 13' of the intake suction area 13 must not be deflected too much in order to enter the fan 9. The in-flow direction in the channels 33 in the edge region 11*a* have an inclination greater than the in-flow direction of the inner channels 33 lying closer to the center axis 13'.

It is advantageous to chamfer the inner transverse struts (32*b*, 32*c*) lying in the overlapping region 28 at the same angle 36.

The configuration of the channels 33 by means of the special arrangement of the struts and transverse struts of the fan screen makes the manufacture of the fan housing 18 as a single piece possible which provides a large screen entrance surface while having a uniform window size. The large inlet surface reduces the flow velocity at the individual windows 30 while their uniform small configuration prevents the entry of larger foreign particles such as dirt, chips and the like. Foreign particles such as chips and the like are also not held tightly over the window since a reduced suction pressure is developed because of the reduced in-flow velocity so that the foreign particles cannot be drawn in by suction.

The fan housing in the form shown includes a hood part 40 which is formed with the housing as a single piece. The hood part 40 defines a common interface with parts of the housing 15 of the tool, namely, an air channel on the pressure side of the fan 9.

In the embodiment shown, the struts 31 and transverse struts 32 extend at right angles to each other whereby windows 30 of uniform size are formed in a simple manner. It can be advantageous to combine radially extending and peripherally extending struts with each other whereby a circular segment-shaped window can be formed.

The width B of a window 30 is greater than the length (u). The distance (u) is determined by the point of intersection of the imaginary extension of a chamber 34' with the deflector section 17 and the imaginary extension of the inner wall defining the window 30 with the wall being at right angles to the surface of the intake suction area 13.

The fan housing 18 can be produced with the injection molding process as one piece with the configuration of the channel 33 with one window 30 having the width B. As shown in FIG. 6, prong-like form pieces (45, 46, 47) are moved into position between which free spaces for forming the struts are provided. In FIG. 6, the strut 32*a* is formed. With the formation of the channels 33, the fan housing 18 is easily removed from the form after the injection process. Accordingly, the form piece 45 is pulled off in the direction of arrow with the arrow 48 extending at an angle corresponding to the angle 35. Thereafter, the form piece 47 is withdrawn in order to free the last form piece 46. The form piece 46 has a form filling out the gap between the form pieces 45 and 47 and can be withdrawn vertically after form pieces 47 and 48 are removed.

It is understood that the foregoing description is that of the preferred embodiments of the invention and that various changes and modifications may be made thereto without departing from the spirit and scope of the invention as defined in the appended claims.

What is claimed is:

1. A portable handheld motor tool such as a motor chain saw, cutoff machine or the like, the motor tool having a work tool and comprising:

a motor housing;

a motor for driving said work tool;

said motor being mounted in said housing and having a drive shaft;

a fan defining an effective intake suction area and being mounted on said drive shaft for drawing a flow of cooling air into said housing and through said intake suction area for cooling the motor;

a fan screen structure mounted on said housing and defining a fan screen for passing the cooling air into the housing from the ambient;

said fan screen defining an intake area through which the cooling air passes and said screen intake area being greater than said intake suction area of said fan;

said structure including a deflector section formed as one piece with said structure, said deflector section being disposed between said fan screen and said fan so as to taper from said screen intake area down to said fan;

said fan screen having an overlap portion overlapping said deflector section to define a space therewith disposed therebetween;

said structure defining a longitudinal axis and including a plurality of radial struts extending approximately radially of said axis so as to extend across said space as solid uninterrupted walls between said overlap portion and said deflector section;

said structure further including a plurality of transverse struts in said slots so as to extend transversely between said walls;

said transverse struts having respective ends facing toward said deflector section; and, each of said ends being chamfered toward said intake suction area.

2. The portable handheld motor tool of claim 1, said radial and transverse struts conjointly defining a plurality of channels directed toward said intake opening; said fan screen having peripheral zones and an inner zone and a first plurality of said channels being arranged in said peripheral zones and a second plurality of said channels being arranged in said inner zone; and, said channels of said first plurality having a greater inclination toward said fan than said channels of said second plurality.

3. The portable handheld motor tool of claim 1, said fan screen having a peripheral outer edge and a first plurality of said transverse struts being directly adjacent said edge; and, a second plurality of said transverse struts being next to the struts of said first plurality of said transverse struts and spaced farther away from said outer edge than said transverse struts of said first plurality thereof; and, the chamfers of said struts of said first plurality of transverse struts being at an angle greater than the chamfers of said second plurality of transverse struts.

4. The portable handheld motor tool of claim 3, said chamfers of said first plurality of struts being at an angle of approximately 30°.

5. The portable handheld motor tool of claim 3, said chamfers of said second plurality of struts being at an angle of approximately 15°.

6. The portable handheld motor tool of claim 3, the ends of said transverse struts of said second plurality of transverse struts all being chamfered at the same angle in the region of said overlap portion.

7. The portable handheld motor tool of claim 3, said radial struts and said transverse struts conjointly defining a plurality of windows, each of said windows having a width (B) measured along the length of a radial strut; the chamfered end of one of said transverse struts defining a first imaginary line extending to said deflector section; and, the surface of said one transverse strut defining a second imaginary line extending to said deflector section; and, said first and second imaginary lines being separated by a distance (u); and, said width (B) being greater than said distance (u).

8. The protable handheld motor tool of claim 1, said intake suction area defining a center axis which is laterally displaced from said longitudinal axis of said structure.

* * * * *

UNITED STATES PATENT AND TRADEMARK OFFICE

CERTIFICATE OF CORRECTION

PATENT NO. : 4,970,993

DATED : November 20, 1990

INVENTOR(S) : Hermann Weiss, Siegfried Frank, Wolfgang Kirtz and Luise Stephani

It is certified that error appears in the above-identified patent and that said Letters Patent is hereby corrected as shown below:

On the title page, under Abstract, line 1: between "relates" and "air cooled" insert -- to an --.

In column 2, line 63: delete "dispersed" and substitute -- disposed -- therefor.

In column 4, line 5: delete "bered" and substitute -- fered -- therefor.

In column 4, line 6: delete "chamber" and substitute -- chamfer -- therefor.

In column 4, line 62: delete "chamber" and substitute -- chamfer -- therefor.

In column 5, line 8: between "arrow" and "with" insert -- 48 --.

In column 5, line 37: delete "an" and substitute -- a screen -- therefor.

UNITED STATES PATENT AND TRADEMARK OFFICE

CERTIFICATE OF CORRECTION

PATENT NO. : 4,970,993

DATED : November 20, 1990

INVENTOR(S) : Hermann Weiss, Siegfried Frank, Wolfgang Kirtz and Luise Stephani

It is certified that error appears in the above-identified patent and that said Letters Patent is hereby corrected as shown below:

In column 6, line 10: delete "opening" and substitute -- suction area -- therefor.

In column 6, line 50: delete "protable" and substitute -- portable -- therefor.

Signed and Sealed this

Fifth Day of May, 1992

*Attest:*

DOUGLAS B. COMER

*Attesting Officer*

*Acting Commissioner of Patents and Trademarks*